US006205626B1

(12) United States Patent
Watanabe et al.

(10) Patent No.: US 6,205,626 B1
(45) Date of Patent: Mar. 27, 2001

(54) BOTTOM END STOP ATTACHING PORTIONS OF FASTENER TAPES AND A SLIDE FASTENER CHAIN INCLUDING THE SAME

(75) Inventors: Kozo Watanabe; Kazuki Kuse, both of Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/306,252

(22) Filed: May 6, 1999

(30) Foreign Application Priority Data

May 29, 1998 (JP) ..... 10-149545

(51) Int. Cl.[7] ..... A44B 19/36
(52) U.S. Cl. ..... 24/434; 24/398; 24/433
(58) Field of Search ..... 24/434, 433, 398, 24/388

(56) References Cited

U.S. PATENT DOCUMENTS

| | | | | |
|---|---|---|---|---|
| 3,911,536 | * | 10/1975 | Shimotani et al. | 24/434 |
| 3,964,137 | * | 6/1976 | Kihara | 24/433 |
| 4,001,922 | * | 1/1977 | Ward, Jr. | 24/434 |
| 4,233,099 | | 11/1980 | McGuire . | |
| 4,459,723 | * | 7/1984 | Takano et al. | 24/434 |
| 4,651,389 | * | 3/1987 | Yoshida et al. | 24/433 |
| 4,742,603 | * | 5/1988 | Kasai | 34/433 |
| 4,870,724 | * | 10/1989 | Fujisaki et al. | 24/433 |
| 5,728,460 | * | 3/1998 | Hirasawa et al. | 24/433 |

FOREIGN PATENT DOCUMENTS

| | | |
|---|---|---|
| 1 213 655 | 3/1966 | (DE) . |
| 0 158 837 | 10/1985 | (EP) . |
| 2 222 036 | 10/1974 | (FR) . |
| 0 179 368 | 4/1986 | (FR) . |
| 2 166 488 | 5/1986 | (GB) . |

* cited by examiner

*Primary Examiner*—Victor N. Sakran
(74) *Attorney, Agent, or Firm*—Hill & Simpson

(57) ABSTRACT

By fusing reinforcing tapes with bottom end attaching portions of fastener tapes by pressurizing heating means with different pressures (i.e., high and low), thus weakening of attaching portions can be prevented. Core threads are fitted to side edges of fastener tapes to form core portions. Reinforcing tapes formed of thermoplastic elastomer film or thermoplastic resin film are fused to wrap tape end portions including the core portions so as to form the bottom end attaching portions. The reinforcing tapes fused the core portions and vicinity portions to the fastener tapes with a low pressure and at tape main body portions to the fastener tapes with a high pressure, thereby making the core portions and the vicinity portions flexible and thick and making the tape main body portions stiff and thin to form stepped portions. The stepped portions are positioned outside flanges of a slider. A box and a box pin are attached to one of the core portion and core portion vicinity portions, and an insert pin is attached to the other core portion and vicinity portions, thereby preventing the attaching portions from being cracked and weakened.

11 Claims, 4 Drawing Sheets

BOTTOM END STOP ATTACHING PORTIONS OF FASTENER TAPES AND A SLIDE FASTENER CHAIN INCLUDING THE SAME

BACKGROUND OF THE INVENTION

1. Field of the Invention

The present invention relates to bottom end attaching portions of fastener tapes and a slide fastener chain including the same wherein end portions of tapes are reinforced in two manners (i.e., strongly and weakly) in order to mount a box pin, a box, and an insert pin to end portions of the fastener tapes of the slide fastener of a separable type having a bottom end stop, thereby firmly fixing the bottom end stop and can be used for a long time.

2. Description of the Related Art

Conventionally, in this separable type of a slide fastener, there is a separable type of well known slide fastener, wherein attaching portions are formed for mounting the bottom end stop to end portions of fastener tapes by bonding narrow taffeta to the end portions of the fastener tapes to harden the entire tapes, so that the box pin, the box, and the insert pin can be mounted to the attaching portions at side edges of hardened fastener tapes.

As an improved bottom end stop attaching portions for the above separable type of slide fastener, as shown in FIG. 6, there are bottom end stop attaching portions as disclosed in Japanese Utility Model Laid-Open Publication No. 44-25842, wherein synthetic resin liquid is coated on end portions of tapes, or synthetic resin film is fused with the end portions of tapes, or taffeta is bonded to the end portions of tapes so as to harden one side edges or both side edges of the tapes to a great extent excluding sewing portions which are hardened to some extent. The box pin, the box, and the insert pin are mounted to this edge portions hardened to a great extent. By partly changing hardness of the fastener tapes, the bottom end stop can be firmly attached and the slide fastener can be easily attached and sewn.

As shown in FIG. 7, there are bottom end stop attaching portions of a slide fastener as disclosed in Japanese Utility Model Publication No. 56-25524, wherein synthetic resin film or auxiliary tape such as taffeta is bonded in two manners (i.e., strongly and weakly) to entire end portions of the fastener tapes to form at the bonded portions, stiff and flat strongly bonded portions and weakly bonded portions which are dotted and highly projecting as compared with the strongly bonded portions, in order to apply proper stiffness and strength to entire bottom end stop attaching portions, and to prevent bending, cracking, and the like of the bottom end stop attaching portions when using the slide fastener, and to prevent sewing yarn being cut by hardened reinforcing portions.

The bottom end stop attaching portions of the separable type of slide fasteners described above and shown in FIGS. 6 and 7, the strongly bonded portions and the weakly bonded portions formed in two manners (i.e., strongly and weakly) are formed at the bonded portions with reinforcing portions such as synthetic resin film and taffeta are bonded to faces of the tapes. However, in both of the above described the bottom end attaching portions, portions to which the box pin, the box, and the insert pin are attached are weakened by excessive pressurizing and heating, and by a twisting force caused when using the slider fastener, crack is made at attachment part of the box pin and the insert pin mounted to the reinforced portions to which the bottom end stop is attached such that separating and inserting operations can not be carried out smoothly.

SUMMARY OF THE INVENTION

The present invention has been accomplished with the above problems in view, and according to a first aspect of the invention, it is objected to provide bottom end stop attaching portions of fastener tapes wherein reinforcing tapes mounted to the bottom end stop attaching portions of the fastener tapes are fused by pressurizing heating means with high and low pressures to prevent attaching portions of a box pin, a box, and an insert pin from being weakened. Particularly, crack made at attachment part of the mounted box pin and the insert pin can be prevented while use. Furthermore, the box pin and the insert pin can be firmly mounted to the flexible attaching portions. Therefore, the bottom end stop attaching portions are durable and will not be damaged for a long time thus separating and inserting operations can be carried out smoothly.

According to a second aspect of the invention, in addition to the first aspect of the invention, it is objected to provide the bottom end stop attaching portions of the fastener tapes having core portions to which the box pin, the box, and the insert pin can be properly and easily mounted, by specifying a shape for fitting core threads forming the core portions to side edges of the fastener tapes.

According to a third aspect of the invention, in addition to the first and the second aspects of the invention, it is objected to provide the bottom end stop attaching portions of the fastener tapes, wherein reinforcing tapes are fused with end portions of the fastener tapes by the pressurizing heating means with high and low pressures so as to form a difference in thickness of the fastener tapes, i.e., to make the portion on the tape which is vicinity to the core portion (herein after call as vicinity portions) thick and tape main body portions thin. Thus, the box pin, the box, and the insert pin can be firmly attached, and the tape main body portions of the tapes facilitate the separating and inserting operations.

According to a fourth and a fifth aspects of the invention, in addition to any one of the first to third aspects of the invention, they are objected to provide the bottom end attaching portions of the fastener tapes, wherein bottom end stop which is suitable for various types of slide fasteners can be attached to the attaching portions, by specifying shapes of the core portions and the vicinity portions disposed at side edges of the fastener tapes.

According to a sixth aspect of the invention, in addition to any one of the first to fifth aspects of the invention, it is objected to provide the bottom end attaching portions of the fastener tapes, wherein surface of the reinforcing tapes excluding the core portions and the vicinity portions to which the bottom end stop is attached are coarsened to prevent slipperiness peculiar to thermoplastic resin, thereby facilitating the separating and inserting operations and sewing an article on to which the bottom end stop is attached.

According to seventh and eighth aspects of the invention, in addition to any one of the first to sixth aspects of the invention, they are objected to provide a slide fastener chain including the metal bottom end stop having the box pin, the box, and the insert pin which are made of metal, or the thermoplastic resin bottom end stop made having the box pin, the box, and the insert pin which are made of thermoplastic resin are crimped to the core portions and the vicinity portions formed at side edges of the fastener tapes.

To achieve the above objects, according to the invention stated the first aspect, there are provided the bottom end attaching portions of the fastener tapes comprising reinforcing tapes 14 with widths corresponding to the box pin 6 and the insert pin 7 are covered around the core portions 2 formed at one side edges of the fastener tapes 1, and are fused with surfaces and rear faces of the tape main body portions 11 of the fastener tapes 1, wherein thermoplastic elastomer film or thermoplastic resin film is used as the reinforcing tapes 14, the reinforcing tapes 14 for wrapping the core portions 2 and the vicinity portions 3 are fuses with the fastener tapes 1 by pressurizing heating means with a low pressure, and the reinforcing tapes 14 disposed on the tape main body portions 11 are fused with the fastener tapes 1 by the pressurizing heating means with a high pressure so as to make the core portions 2 and the vicinity portions 3 flexible and to make the tape main body portions 11 stiff.

According to the invention stated in the second aspect, in addition to the structure of the invention stated in the first aspect, there are provided the bottom end attaching portions of the fastener tapes, wherein the core threads 9 are fitted and woven by weaving means or knitted by knitting means or sewn by sewing means on side edges of the fastener tapes 1 to form a series of the core portions 2, the reinforcing tapes 14 made of thermoplastic elastomer film or thermoplastic resin film wrap the core portions 2 and are fused with a lower pressure than that of fusing the reinforcing tapes 14 with the tape main body portions 11 of the fastener tapes 1 to form the core portions 2 and the vicinity portions 3 at one side edges of the fastener tapes 1.

According to the invention stated in the third aspect, in addition to the structure of the invention stated in the first and the second aspects, there are provided the bottom end attaching portions of the fastener tapes, wherein the tape main body portions 11 of the fastener tape 1 with which the reinforcing tapes 14 made of thermoplastic elastomer film or thermoplastic resin film are fused with a high pressure is thin, the vicinity portions 3 with which the reinforcing tapes 14 are fused with a low pressure is thick, stepped portions 15 which have difference in height are formed between the tape main body portions 11 and the vicinity portions 3 on surfaces of the fastener tapes 1, and the stepped portions 15 are positioned outside flanges 21 of a mounted slider 20.

According to the invention stated in the fourth aspect, in addition to the structure of the invention stated in any one of the first to third aspects, there are provided the bottom end attaching portions of the fastener tapes, wherein the core portions 2 and the vicinity portions 3 to which the reinforcing tapes 14 made of thermoplastic elastomer film or thermoplastic resin film are fused with a low pressure are formed on only one faces of the fastener tapes 1.

According to the invention stated in the fifth aspect, in addition to the structure of the invention stated in any one of the first to third aspects, there are provided the bottom end attaching portions of the fastener tapes, wherein the core portions 2 and the vicinity portions 3 to which the reinforcing tapes 14 made of thermoplastic elastomer film or thermoplastic resin film are fused with a low pressure are symmetrically formed on both faces of the fastener tapes 1.

According to the invention stated in the sixth aspect, in addition to the structure of the invention stated in any one of the first to fifth aspects, there are provided the bottom end attaching portions of the fastener tapes, wherein notches 16 are formed by a knurling processing on surfaces of the reinforcing tapes 14 made of thermoplastic elastomer film or thermoplastic resin film fused with surfaces of the fastener tapes 1 excluding the core portions 2 and the vicinity portions 3 formed at one side edges of the fastener tapes 1 so as to coarsen the surfaces of the reinforcing tapes 14.

According to the invention stated in the seventh aspect, in addition to the structure of the invention stated in any one of the first to sixth aspects, there is provided a slide fastener chain, wherein the box pin 6, the box 5, and the insert pin 7 which are made of metal wrap the core portions 2 provided to the bottom end stop attaching portion of the fastener tapes stated in any one of the first to sixth aspects, and these end portions of the box pin 6, the box 5, and the insert pin 7 adhere to the vicinity portions 3 by pressing means, thereby mounting the bottom end stop 4.

According to the invention stated in the eighth aspect, in addition to the structure of the invention stated in any one of the first to sixth aspects, there is provided a slide fastener chain, wherein the box pin 6, the box 5, and the insert pin 7 which are made of thermoplastic resin wrap the core portions 2 provided to the bottom end stop attaching portions of the fastener tapes stated in any one the first to sixth aspects, and end portions of the box pin 6 and the insert pin 7 adhere to the vicinity portions 3 by injection molding means, thereby mounting the bottom end stop 4.

DESCRIPTION OF THE PREFERRED EMBODIMENTS

Figure 1:
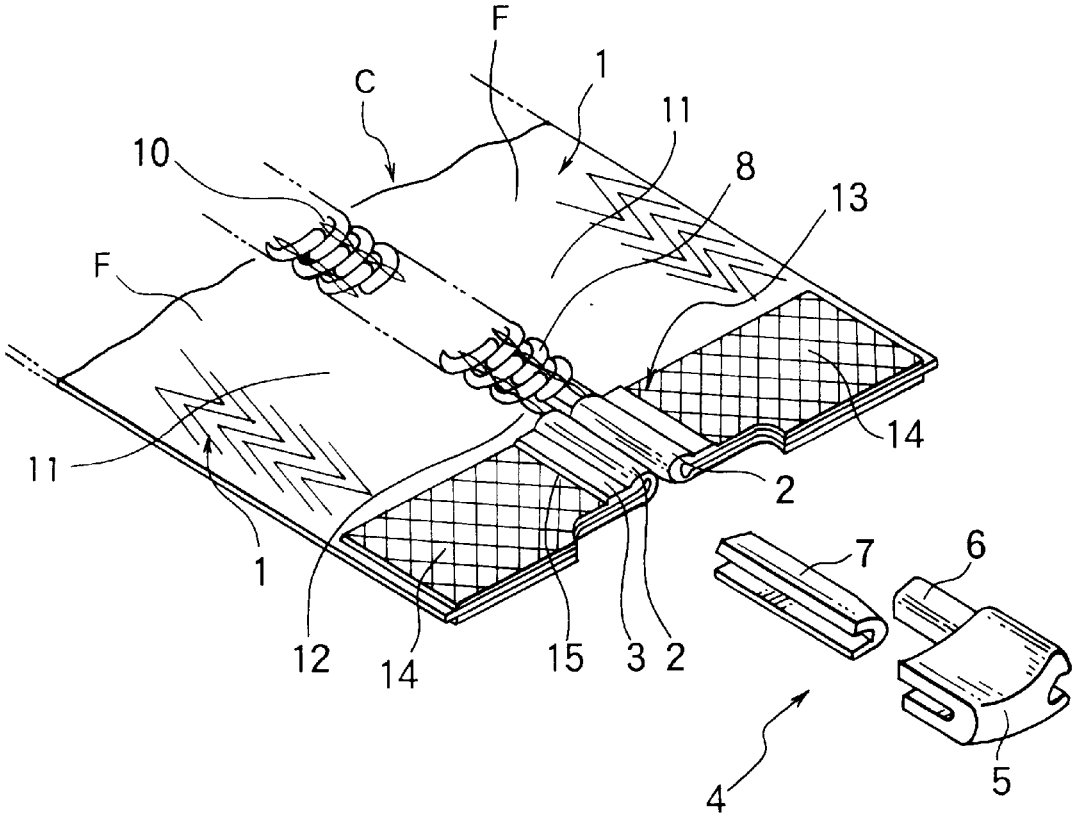
FIG. 1 is an exploded perspective view of the bottom end attaching portions of a first embodiment.
Figure 2:
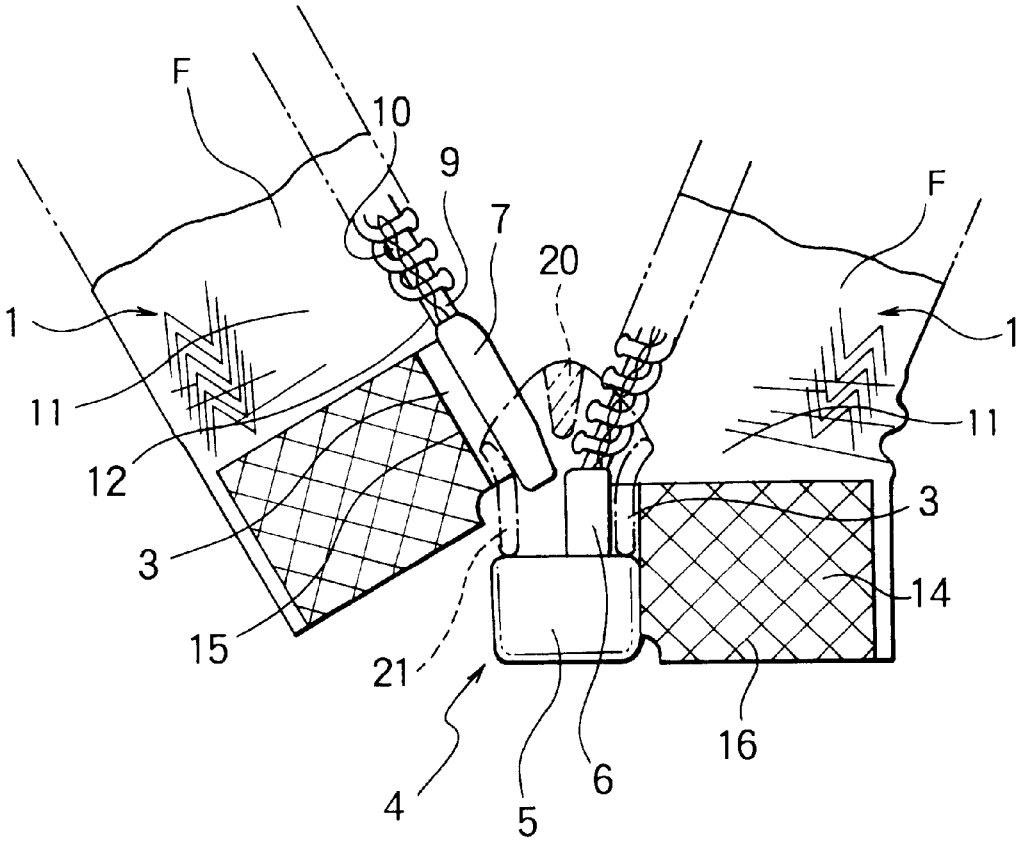
FIG. 2 is a front view of the bottom end attaching portions in a separated state.

Embodiments of the bottom end stop attaching portions of the fastener tapes of the present invention will be described in detail by reference to the drawings.

In the bottom end stop attaching portions 13 of the fastener tapes 1 of the invention, a pair of fastener tapes 1 is formed by weaving or knitting synthetic fiber yarn of polyamide, polyester or the like, the core thread 9 is fitted to side edges of each the fastener tape 1 to form the core portion 2, various fastener elements which is discrete type or continuous wire rod type made of metal such as zinc alloy, aluminum alloy, and the like or made of thermoplastic resin such as polyamides, polyacetal, polypropylene, polybutyrene terephthalate, and the like are mounted to the core portion 2, and the bottom end stop 4 including the box 5, the box pin 6, and the insert pin 7 made of the same material as that of the above fastener elements is mounted to the bottom end stop attaching portions 13 at end portions of the fastener tapes 1, thereby forming a slide fastener chain.

The bottom end stop attaching portions 13 of the invention for attaching the bottom end stop 4 to the end portions of the fastener tapes 1 will be described in detail. As shown in FIGS. 1 to 4, the core thread 9 is inserted through coil-shaped fastener elements 8 made of monofilament which are thermoplastic resin at side edges of each the fastener tapes 1. The fastener elements 8 and the core thread 9 are sewn on the side edges of the fastener tape 1 by using the sewing yarn 10 to form continuous fastener chain C.

The continuous fastener chain C is defined with space portions 12 having a predetermined length where only the fastener elements 8 are removed, the length corresponding to a size of a product, i.e., the slide fastener. Bottom end stop attaching portions 13 to which the bottom end stop 4 is attached are formed at the space portions 12. In order to attach the bottom end stop 4, reinforcing tapes 14 formed of thermoplastic elastomer film made of styrene butadiene styrene blockcopolymer, thermoplastic polyurethane, or the like or thermoplastic resin film made of polyamide, polyethylene, or the like, and having a width slightly larger than that of the bottom end stop 4 wrap the core threads 9 inserted through the coil-shaped fastener elements 8 and the sewing yarn 10 used for sewing the core threads 9 which are left on one side edges of the fastener tapes 1. The reinforcing tapes 14 are fused with the fastener tapes 1 by pressurizing heating means such as ultrasonic processing and high frequency processing to form the core portions 2, and both ends of the reinforcing tapes 14 crimp and fix to surfaces and rear faces of the fastener tapes 1, thereby forming the bottom end stop attaching portions 13.

It is preferable that the reinforcing tapes 14 formed of the thermoplastic elastomer film or the thermoplastic resin film are transparent and color of the fastener tapes 1 can be seen through the reinforcing tapes 14. As a result, it is not necessary to match colors of the fastener tapes 1 and the reinforcing tapes 14 with each other and not necessary to prepare reinforcing tapes 14 with various colors, and thus, an inventory control is easy.

Figure 3:
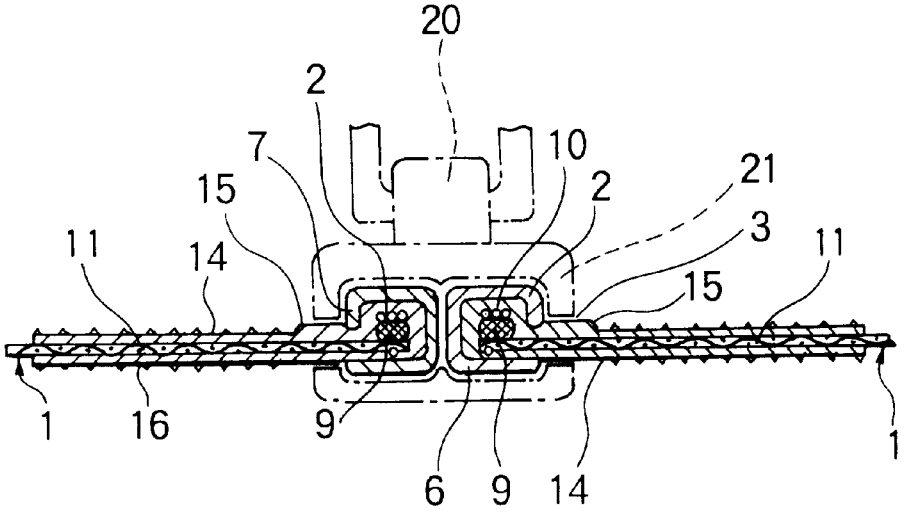
FIG. 3 is a sectional view of the bottom end stop attaching portions in a closed state.
Figure 4:
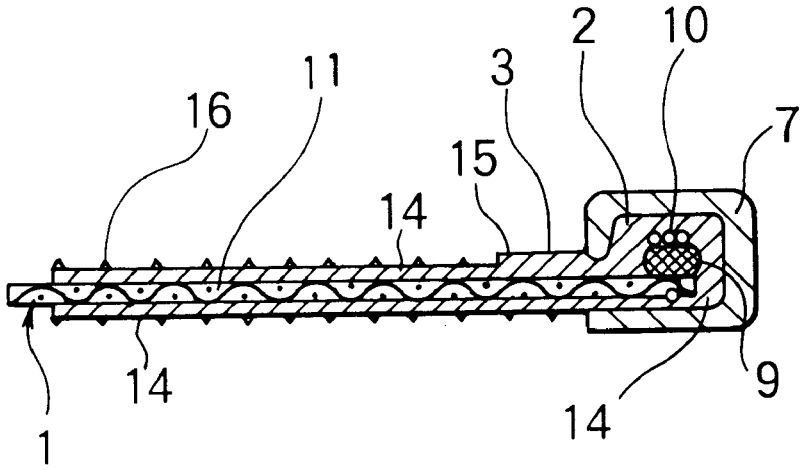
FIG. 4 is a sectional view of the bottom end stop attaching portions mounted with the insert pin.

When the reinforcing tapes 14 are fused with the fastener tapes 1, as shown in FIGS. 3 and 4, the reinforcing tapes 14 for wrapping the core threads 9 and the sewing yarn 10 on one side edges of the fastener tapes 1 to form the core portions 2 and for forming the vicinity portions 3 in adjacent to the core portions 2 are fused with a low pressure, while the reinforcing tapes 14 disposed on tape main body portions 11 of the fastener tapes 1 are fused with the fastener tapes 1 with a high pressure. As a result, the core portions 2 and the vicinity portions 3 are thick and more flexible than the tape main body portions 11. Because the tape main body portions 11 are fused with the high pressure, they are thin and stiff. The stepped portions 15 which have difference in height are formed at boundaries between the vicinity portions 3 and the tape main body portions 1. The stepped portions 15 are disposed at outside positions where the flanges 21 of the slider 20 mounted to the fastener chain C are positioned.

The notches 16 are laterally and longitudinally applied to the reinforcing tapes 14 by knurling processing, the reinforcing tapes 14 being fused with the surfaces and rear faces of the tape main body portions 11, so as to coarsen the reinforcing tapes 14. Thus, slipperiness of the reinforcing tapes 14 peculiar to thermoplastic resin is eliminated, and the reinforcing tapes 14 can be in friction contact with articles on to which the bottom end stop is attached.

The core portions 2 and the vicinity portions 3 of the bottom end stop attaching portions 13 formed at the space portions 12 of the fastener chain C are mounted with the bottom end stop 4 as shown in FIG. 1. To side edges of one of a fastener stringers F, an unit member formed by uniting the box 5 and the box pin 6 is crimped by a pressing processing such that the box pin 6 clamps the core portion 2. An upper end edge of the box pin 6 crimp and bite into the vicinity portion 3 as shown in FIG. 4. It is also possible that the box 5 and the box pin 6 are molded separately and the box pin 6 is fitted and fixed to the box 5. The insert pin 7 to be inserted into the box 5 is crimped to side edges of the other fastener stringer F such that the insert pin 7 wraps the core portion 2 and an end edge of the insert pin 7 bites into the vicinity portions 3 similarly to the box pin 6. As a result, the box pin 6 and the insert pin 7 are stably mounted along the core portions 2 without deviating from the desired positions.

Although the bottom end stop 4 is made of metal in the above-described embodiment, it is also possible that thermoplastic resin such as polyamide, polyacetal, polypropylene, and polybutyrene terephthalate is used as material of the bottom end stop 4, the box 5, box pin 6, insert pin 7 are molded to wrap the core portions 2 and the vicinity portions 3 at the bottom end stop attaching portions 13 at the space portions 12 of the fastener tapes 1 by injection molding means, and the bottom end stop 4 is mounted similarly to the bottom end stop 4 made of metal.

Figure 5:
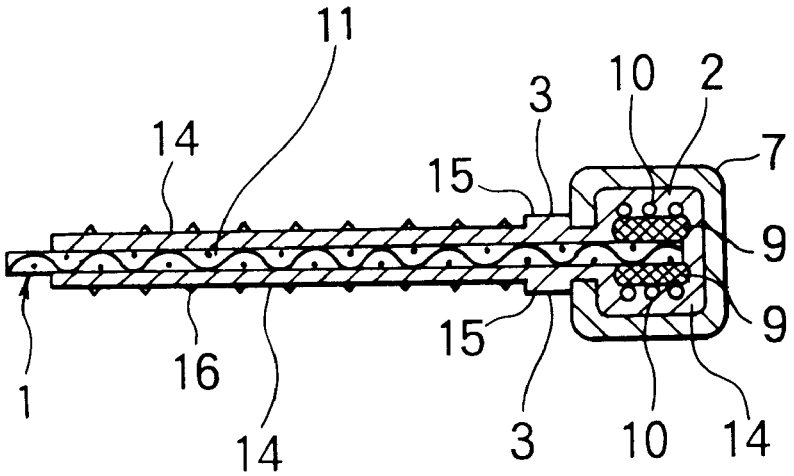
FIG. 5 is a sectional view of the bottom end attaching portions of a second embodiment mounted with the insert pin.
Figure 6:
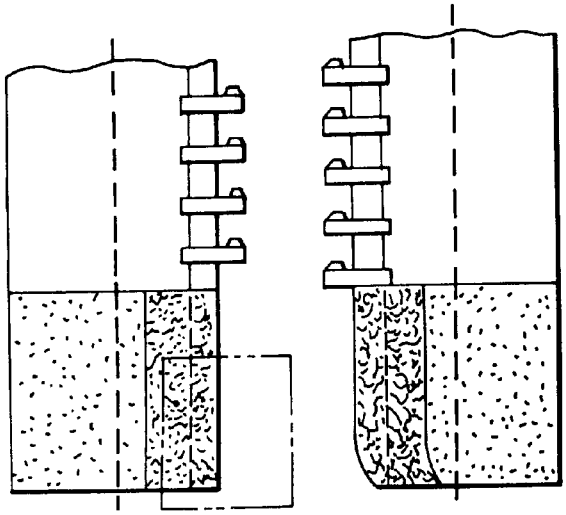
FIG. 6 is a front view of known bottom end stop attaching portions.
Figure 7:
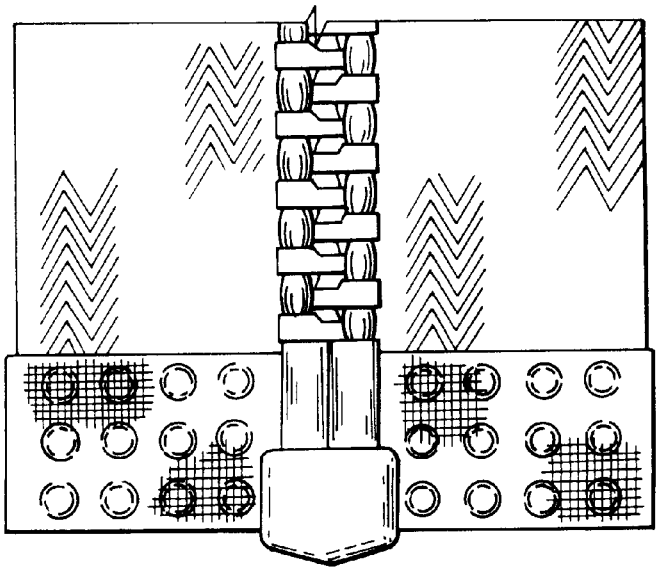
FIG. 7 is a front view of other known bottom end stop attaching portions.

In an embodiment shown in FIG. 5, the bottom end stop attaching portions 13 comprises the core thread 9, fitted and fixed to both faces of side edges of each the fastener tape 1, and the core portion 2 sewn with the sewing yarn 10 on the both faces. The reinforcing tapes 14 are fused with the both faces of the fastener tape 1 by pressurizing heating means with a die which has difference in height. The core portion 2 and the vicinity portions 3 are formed symmetrically on the both faces of the fastener tape 1. The core portion 2 formed by weaving or knitting the core threads 9 into the fastener tape 1 simultaneously with weaving or knitting of the fastener tape 1 is formed in a same form as described above, i.e., the core portion 2 and the core portion vicinity portions 3 are formed symmetrically on both faces of the fastener tape 1. For above shapes of the core portions 2 and the vicinity portions 3, the fastener element to be mounted to the core portion 2 is made of metal or thermoplastic resin and which is discrete type is suitable, and a zigzag type fastener element formed of monofilament made of thermoplastic resin is also suitable.

The box pin 6 or the insert pin 7 of the bottom end stop 4 mounted to the fastener stringer F of the above shape preferably includes the edge portions which are bent to form right angles such that the end edges can clamp the vicinity portions 3 from above and below and can be crimped to the vicinity portion3. The vicinity portions 3 are formed such that the flanges of the slider 20 can be in sliding contact with the vicinity portions 3. Furthermore, the vicinity portions 3 reinforce the core portions 2.

The bottom end stop attaching portions of the fastener tapes of the invention have structures as described above, and have the following effects by those structures.

According to the invention stated in the first aspect, in the bottom end stop attaching portions of the fastener tapes comprising the reinforcing tapes which correspond to the box pin and the insert pin are covered around the core portions, and are fused with the surfaces and rear faces of the tape main body portions, thermoplastic elastomer film or thermoplastic resin film is used as the reinforcing tapes, the reinforcing tapes for wrapping the core portions and the vicinity portions are fuses with the fastener tapes by pressurizing heating means with a low pressure, and the reinforcing tapes disposed on the tape main body portions are fused with the fastener tapes by the pressurizing heating means with a high pressure so as to make the core portions and the vicinity portions flexible and to make the tape main body portions stiff. Because the reinforcing tapes mounted to the bottom end stop attaching portions of the fastener tapes are fused by pressurizing heating means with high and low pressures to make the tape main body portions stiff and to make the core portions and the vicinity portions flexible, easy damage of the box pin and the insert pin due to weakening of the attaching portions can be prevented. Therefore, the box pin and the insert pin can be firmly cramped to the attaching portions. Moreover, crack being made when attaching the box pin and the insert pin can be suppressed even if a twisting force is applied to the attaching portions when using the slide fastener, thus the attaching portions are durable even if they are used for a long time, and separating and inserting operations can be carried out smoothly.

According to the invention stated in the second aspect, in addition to the effects of the invention stated in the first aspect, because the core threads are fitted and woven or knitted or sewn on the side edges of the fastener tapes to form the core portions and the reinforcing tapes wrap the core portions and are fused with a lower pressure than the tape main body portions to form the core portions and the vicinity portions, the bottom end stop can be properly and firmly mounted to the core portions of various types of fastener tapes.

According to the invention stated in the third aspect, in addition to the effects of the invention stated in the first and second aspects, because the tape main body portions with which the reinforcing tapes are fused with a high pressure is thin, the vicinity portions with which the reinforcing tapes are fused with a low pressure thick, the stepped portions are formed between the tape main body portions and the vicinity portions, and the stepped portions are positioned outside the flanges of the slider, thus the bottom end stop can be firmly mounted to the attaching portions and the slider can be slidably guided on the vicinity portions in a stable state.

According to the invention stated in the fourth aspect, in addition to the effects of the invention stated in any one of the first to third aspects, because the core portions and the vicinity portions to which the reinforcing tapes are fused with a low pressure are formed on one faces of the fastener tapes, the bottom end stop can be properly and firmly mounted with the slide fastener wherein fastener elements are mounted to one side edges of the fastener tapes and separating and inserting operations can be carried out smoothly.

According to the invention stated in the fifth aspect, in addition to the effects of the invention stated in any one of the first to third aspects, because the core portions and the vicinity portions to which the reinforcing tapes are fused with a low pressure are symmetrically formed on both faces of the fastener tapes, the bottom end stop can be properly and firmly mounted with the slide fastener wherein the fastener elements are mounted to both faces of one side edges of the fastener tapes and separating and inserting operations can be carried out smoothly.

According to the invention stated the sixth aspect, in addition to the effects of the invention stated in any one of the first to fifth aspect, because the notches are formed by a knurling processing on surfaces of the reinforcing tapes fused with faces of the fastener tapes excluding the core portions and the vicinity portions, surfaces of the tape main body portions are coarse and can be in contact with the articles to which the tapes are mounted in a stable state. As a result, the tapes can be easily sewn on the articles, and the slider can slide smoothly while the slider is in sliding contact with the vicinity portions.

According to the inventions stated in the seventh and eighth aspects, in addition to the effects of the invention stated in any one of the first to sixth aspects, because the box pin, the box, and the insert pin which are made of metal are mounted to the bottom end stop attaching portions of the fastener tapes such that the box pin, the box, and the insert pin wrap the core portions and end edges of the box pin, the box, and the insert pin adhere to the vicinity portions by pressing means, or because the box pin, the box, and the insert pin which are made of thermoplastic resin are mounted to the attaching portions such that the box pin, the box, and the insert pin wrap the core portions and cramped to the vicinity portions by injection molding means, the bottom end stop made of metal or thermoplastic resin can be firmly attached to the bottom end stop attaching portions of the fastener tapes, and various types of slide fastener chains can be easily supplied at the requests of clients.

What is claimed:

1. Bottom end stop attaching portions of fastener tapes comprising reinforcing tapes which correspond to a box pin and an insert pin, are covered around core portions, and are fused with surfaces and rear faces of tape main body portions, the reinforcing tapes covered around the core portions and vicinity portions adjacent to the core portions are fused with the fastener tapes by pressurizing heating means with a first pressure, and the reinforcing tapes disposed on the tape main body portions are fused with the fastener tapes by the pressurizing heating means with a higher pressure than the first pressure, wherein the core portions and the vicinity portions have a greater flexibility than the tape main body portions.

2. Bottom end stop attaching portions of fastener tapes according to claim 1, wherein core threads are fitted and woven or knitted or sewn on side edges of the fastener tapes to form the core portions, and the reinforcing tapes wrap the core portions and are fused with a lower pressure than the tape main body portions to form the core portions and the vicinity portions.

3. Bottom end stop attaching portions of fastener tapes according to claim 1, wherein the tape main body portions with which the reinforcing tapes are fused with a high pressure are thin, the vicinity portions with which the reinforcing tapes are fused with a low pressure are thick, stepped portions are formed between the tape main body portions and the vicinity portions, and the stepped portions are positioned outside flanges of a slider.

4. Bottom end stop attaching portions of fastener tapes according to claim 1, wherein the core portions and the vicinity portions to which the reinforcing tapes are fused with a low pressure are formed on one face of each of the fastener tapes.

5. Bottom end stop attaching portions of fastener tapes according to claim 1, wherein the core portions and the vicinity portions to which the reinforcing tapes are fused with a low pressure are symmetrically formed on both faces of the fastener tapes.

6. Bottom end stop attaching portions of fastener tapes according to claim 1, wherein notches are formed by a knurling processing on surfaces of the reinforcing tapes fused with faces of the fastener tapes excluding the core portions and the vicinity portions.

7. A slide fastener chain according to claim 1, wherein the box pin, a box, and the insert pin which are made of metal wrap their respective core portions provided to the bottom end stop attaching portions of the fastener tapes, and end edges of the box pin, the box, and the insert pin adhere to the vicinity portions by pressing means.

8. A slide fastener chain according to claim 1, wherein the box pin, a box, and the insert pin which are made of thermoplastic resin wrap their respective core portions provided to the bottom end stop attaching portions of the fastener tapes, and adhere to the vicinity portions by injection molding means.

9. Bottom end stop attaching portions of fastener tapes according to claim 1, wherein the reinforcing tapes comprise one of thermoplastic elastomer film and thermoplastic resin film.

10. A bottom end stop attaching portion of a slide fastener tape, comprising:

a pin attaching edge on the fastener tape;

a body portion of the fastener tape adjacent to the pin attaching edge and having opposite side faces; and a reinforcing tape bonded to the opposite side faces of the fastener tape body portion and to the fastener tape pin attaching edge;

the reinforcing tape having a first portion covering the pin attaching edge and extending over part of the body portion, and a second portion extending from the first portion further over the body portion, the first portion of the reinforcing tape having a greater flexibility than the second portion of the reinforcing tape.

11. A method of reinforcing a bottom end stop attaching portion of a slide fastener tape, comprising the steps of:

covering a pin attaching portion of the fastener tape and a bottom portion of a main body portion of the fastener tape with a reinforcing tape;

attaching a first portion of the reinforcing tape to the pin attaching portion and to part of the bottom portion of the fastener tape by applying pressure and heat; and attaching a second portion of the reinforcing tape adjacent the first portion to the bottom portion of the fastener tape by applying pressure and heat with a greater pressure than the pressure applied to the first portion.

* * * * *